US012503786B1

(12) United States Patent
Chen et al.

(10) Patent No.: US 12,503,786 B1
(45) Date of Patent: Dec. 23, 2025

(54) SURFACE TREATMENT METHOD

(71) Applicant: ASUSTEK COMPUTER INC., Taipei (TW)

(72) Inventors: Tao Chen, Taipei (TW); Po-Wen Huang, Taipei (TW); Yu-Chun Yang, Taipei (TW); Er-Bao Niu, Taipei (TW); Guo-Lin Yang, Taipei (TW); Yen-Chih Chen, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 18/958,411

(22) Filed: Nov. 25, 2024

(30) Foreign Application Priority Data

Aug. 26, 2024 (CN) ..... 202411174100.6

(51) Int. Cl.
*C25D 11/24* (2006.01)
*C25D 11/26* (2006.01)

(52) U.S. Cl.
CPC ..... *C25D 11/246* (2013.01); *C25D 11/243* (2013.01); *C25D 11/26* (2013.01)

(58) Field of Classification Search
None
See application file for complete search history.

(56) References Cited

U.S. PATENT DOCUMENTS

2019/0242026 A1* 8/2019 Choi ..... C25D 11/246
2020/0056300 A1* 2/2020 Curran ..... H05K 5/0243

FOREIGN PATENT DOCUMENTS

CN 104389196 A 3/2015
CN 106265290 A 1/2017
CN 108531960 A 9/2018
CN 109135442 A2 1/2019

* cited by examiner

*Primary Examiner* — Wojciech Haske
(74) *Attorney, Agent, or Firm* — Muncy, Geissler, Olds & Lowe, P.C.

(57) ABSTRACT

The disclosure provides a surface treatment method. The surface treatment method includes the following steps. First, a housing is provided. Subsequently, a liquid is prepared, where the liquid includes at least one anti-mosquito ingredient. Next, an anodizing treatment is performed on the housing, to form micropores on a surface of the housing. Then the housing is immersed in the liquid. Finally, the micropores on the surface of the housing are sealed.

10 Claims, 4 Drawing Sheets

SURFACE TREATMENT METHOD

CROSS-REFERENCE TO RELATED APPLICATION

This application claims the priority benefit of China Application Serial No. 202411174100.6, filed on Aug. 26, 2024. The entirety of the above-mentioned patent application is hereby incorporated by reference herein and made a part of specification.

BACKGROUND OF THE INVENTION

Field of the Invention

The disclosure relates to a surface treatment method, and in particular, to a surface treatment method involving an anodizing treatment.

Description of the Related Art

An electronic device such as a notebook computer, a tablet computer, or a smartphone is an indispensable product for daily work of a user. The user often sits still for a long time when operating the electronic device. However, With the arrival of high temperature climate in summer, mosquitoes began to wreak havoc everywhere. The user is easily disturbed by mosquitoes and even bitten when operating the electronic device such as the notebook computer, the tablet computer, or the smartphone. In this way, in addition to affecting operating experience of the user, mosquito bites also cause symptoms such as itching and pain of human skin, and even spread various diseases.

BRIEF SUMMARY OF THE INVENTION

The disclosure provides a surface treatment method. The surface treatment method includes the following steps. First, a housing is provided. Subsequently, a liquid is prepared, where the liquid includes at least one anti-mosquito ingredient. Next, an anodizing treatment is performed on the housing, to form micropores on a surface of the housing. Then the housing is immersed in the liquid. Finally, the micropores on the surface of the housing are sealed.

Through the surface treatment method provided in the disclosure, the anti-mosquito ingredient is injected into the housing through the anodizing treatment, thereby providing an anti-mosquito function for the housing. In this way, a problem that the user is easily disturbed and bitten by mosquitoes when operating an electronic device such as a laptop computer, a tablet computer, and a smartphone is avoided, thereby improving operating experience of the user.

DETAILED DESCRIPTION OF THE EMBODIMENTS

Specific embodiments of the disclosure are described in more detail below with reference to the schematic diagrams.

Advantages and features of the disclosure are to be clearer according to the following descriptions and claims. It is to be noted that all the figures are in a very simple form and in an inaccurate proportion, and are merely intended to assist description of the purpose of the embodiments of the disclosure conveniently and clearly.

Figure 1:
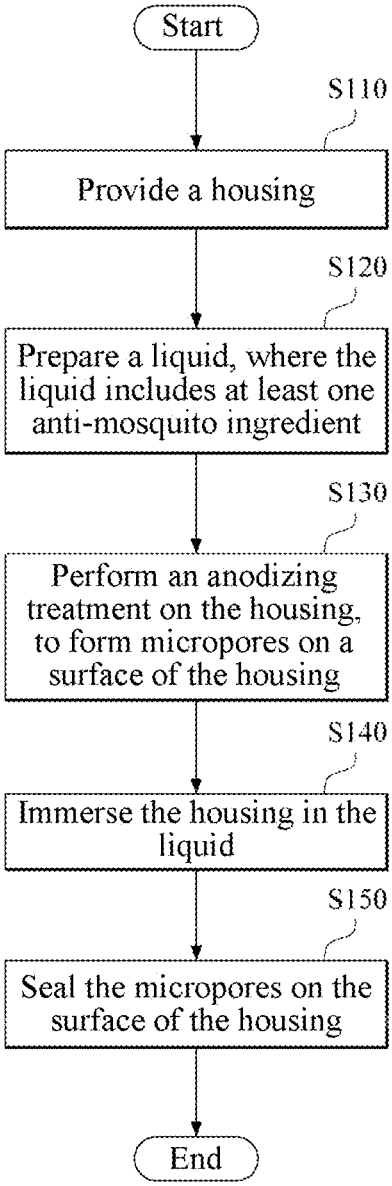
FIG. 1 shows a flowchart of a surface treatment method according to an embodiment of the disclosure.

FIG. 1 shows a flowchart of a surface treatment method according to an embodiment of the disclosure. The surface treatment method is applicable to a material on which an anodizing treatment is performed. In an embodiment, the material includes aluminum, an aluminum alloy, titanium, a titanium alloy, or the like. The aluminum refers to pure aluminum. The aluminum alloy refers to a mixture composed of aluminum as the base and other alloying elements. Similarly, the titanium refers to pure titanium. The titanium alloy refers to a mixture composed of titanium as the base and other alloying elements.

As shown in the figure, the surface treatment method in this embodiment includes the following steps.

First, as described in step S110, a housing is provided. The housing is composed of aluminum, an aluminum alloy, titanium, or a titanium alloy.

Subsequently, as described in step S120, a liquid is prepared. In an embodiment, a main ingredient of the liquid is water, and the liquid includes at least one anti-mosquito ingredient.

In an embodiment, the anti-mosquito ingredient in the liquid includes a natural anti-mosquito ingredient such as ethyl butylacetylaminopropionate (insect repellent 3535, IR3535), p-Menthane-3,8-diol (PMD for short), citronellol, and eucalyptus. In an embodiment, if a total amount of the liquid is 1000 mL, the foregoing anti-mosquito ingredient includes ethyl butylacetylaminopropionate of 25 g, p-Menthane-3,8-diol of 10 g, citronellol of 3 g, and eucalyptus of 1 g.

Next, as described in step S130, an anodizing treatment is performed on the housing, to form micropores on a surface of the housing. In an embodiment, in step S130, a sulfuric acid anolyte is used to perform the anodizing treatment on the housing.

The anodizing treatment refers to a surface treatment technology that uses an electrochemical method to use a workpiece (metal or an alloy) as an anode and perform an electrolytic oxidation treatment on the workpiece to form a dense oxide layer on a surface of the workpiece. For this embodiment, the workpiece mentioned in the preceding paragraph is the housing. In addition, for a workpiece composed of the aluminum metal, the aluminum alloy, the titanium metal, and the titanium alloy, after the anodizing treatment is performed on the workpiece, a porous oxide layer is formed on the surface of the workpiece, and a large number of micropores is generated on the surface of the workpiece.

In an embodiment, through the step of the anodizing treatment performed in step S130, micropores with a size ranging from 20 nanometers to 40 nanometers are generated on the surface of the housing, to ensure that the liquid effectively permeates the micropores in subsequent steps. In addition, it is also ensured that the pore sealing step effectively prevents the liquid inside the micropores from leaking out.

Then as described in step S140, the housing is immersed in the liquid to ensure that the liquid fully permeates the micropores.

Finally, as described in step S150, the micropores on the surface of the housing are sealed to prevent the liquid filled in the micropores from leaking out. In an embodiment, the housing is soaked in hot water at 90 degrees Celsius to 100 degrees Celsius to seal the micropores on the surface of the housing. However, the disclosure is not limited thereto. Another pore sealing treatment, such as treatment by using a nickel salt, treatment by using water vapor, or treatment by using chromic acid, is also applicable to the disclosure.

Figure 2:
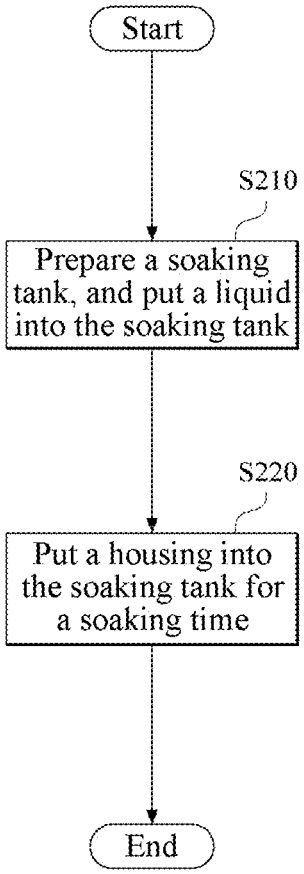
FIG. 2 is an embodiment of step S140 in FIG. 1.

Refer to FIG. 2 together. FIG. 2 shows an embodiment of step S140 in FIG. 1.

As shown in the figure, first, as described in step S210, a soaking tank is prepared, and a liquid is put in the soaking tank.

Then as described in step S220, the housing is put in the soaking tank, and the liquid is maintained at 20 degrees Celsius to 30 degrees Celsius. The soaking time is substantially controlled at 15-40 minutes.

In this way, a situation of sealing due to an excessively high temperature at which the liquid is soaked is avoided, and it is ensured that the liquid (especially an anti-mosquito ingredient in the liquid) is effectively filled into micropores generated by performing an anodizing treatment.

Figure 3:
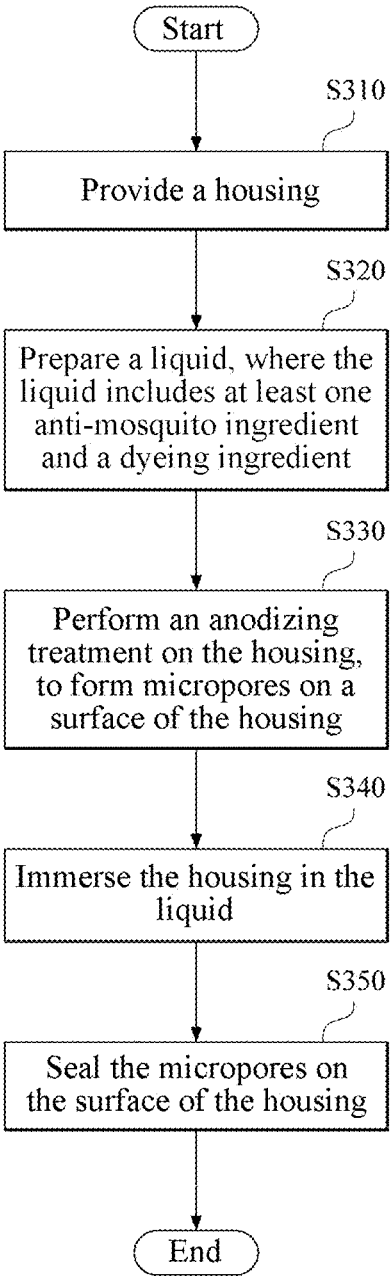
FIG. 3 shows a flowchart of a surface treatment method according to another embodiment of the disclosure.

FIG. 3 shows a flowchart of a surface treatment method according to another embodiment of the disclosure.

As shown in the figure, the surface treatment method in this embodiment includes the following steps.

First, as described in step S310, a housing is provided. The housing is composed of aluminum, an aluminum alloy, titanium, or a titanium alloy.

Subsequently, as described in step S320, a liquid is prepared. The liquid includes at least one anti-mosquito ingredient and one dyeing ingredient.

In an embodiment, the anti-mosquito ingredient in the liquid includes a natural anti-mosquito ingredient such as ethyl butylacetylaminopropionate, p-Menthane-3,8-diol, citronellol, and eucalyptus. In an embodiment, the foregoing dyeing ingredient is selected from a group consisting of natural dyes such as bluegrass, safflower, turmeric, and gardenia.

Next, as described in step S330, an anodizing treatment is performed on the housing, to form micropores on a surface of the housing.

Then as described in step S340, the housing is immersed in the liquid to ensure that the liquid fully permeates the micropores. In an embodiment, a soaking time of the housing is approximately 15-40 minutes, to ensure that the housing is fully dyed.

Finally, as described in step S350, the micropores on the surface of the housing are sealed to prevent the liquid filled in the micropores from leaking out. In an embodiment, the housing is soaked in hot water at 90 degrees Celsius to 100 degrees Celsius to seal the micropores on the surface of the housing. However, the disclosure is not limited thereto. Another pore sealing treatment, such as treatment by using a nickel salt, treatment by using water vapor, or treatment by using chromic acid, is also applicable to the disclosure.

In addition, in an embodiment, the sealed housing is further baked. A baking temperature is in a range of 65-75 degrees Celsius, and a baking time is in a range of 30-45 minutes. The baking step ensures that moisture adhering to a surface of the housing is completely drained in the previous pore sealing step.

A main difference between this embodiment and the embodiment of FIG. 1 is that the liquid used in this embodiment includes the anti-mosquito ingredient and the dyeing ingredient, and simultaneously provides a desired color and an anti-mosquito effect for the housing.

Figure 4:
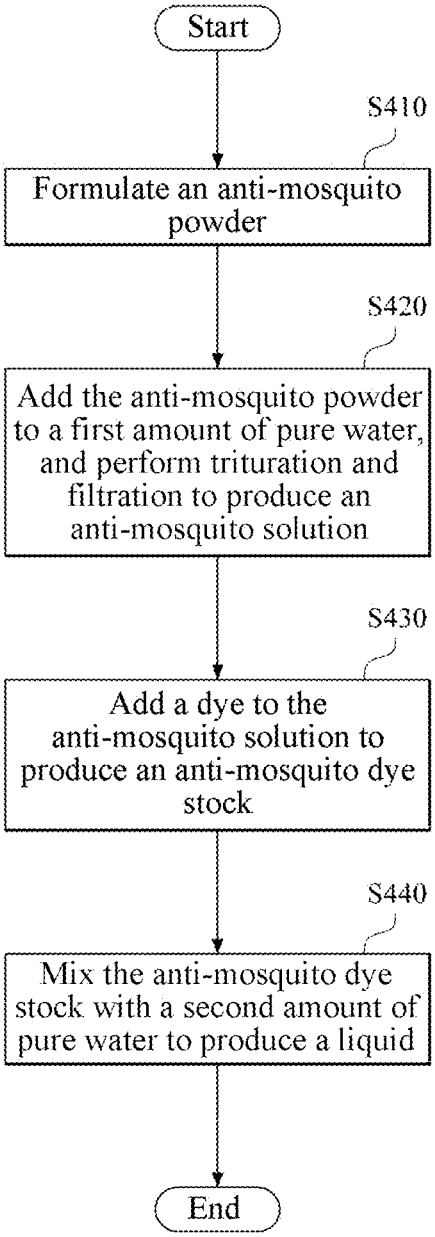
FIG. 4 is an embodiment of step S320 in FIG. 3.

Refer to FIG. 4 together. FIG. 4 is an embodiment of step S320 in FIG. 3.

As shown in the figure, first, as described in step S410, an anti-mosquito powder is formulated. The anti-mosquito powder includes a powder composed of a natural anti-mosquito ingredient such as ethyl butylacetylaminopropionate, p-Menthane-3,8-diol, citronellol, and eucalyptus.

Subsequently, as described in step S420, the anti-mosquito powder is added to a first amount of pure water, and trituration and filtration are performed to produce an anti-mosquito solution.

Then as described in step S430, a dye is added to the anti-mosquito solution to produce an anti-mosquito dye stock. In an embodiment, the dye is selected from a group consisting of natural dyes such as bluegrass, safflower, turmeric, and gardenia.

In an embodiment, in the foregoing steps S420 and S430, the formulated anti-mosquito powder is put into an appropriate amount of pure water, and trituration is performed for 2-3 hours at a high speed. In the process, an appropriate amount of pure water is added based on the situation. In an embodiment, then filtration is performed by using a 3000-mesh double-layer strainer to obtain the anti-mosquito solution. In an actual operation, the foregoing filtration operation is usually repeated 3-5 times.

Then the anti-mosquito solution is sealed and allowed to stand at a room temperature for 48 hours, and then filtered. In an embodiment, filtration is performed by using a 3000-mesh strainer. Then upper 70% by volume of the filtered anti-mosquito solution is extracted, the formulated dye is added, and a microwaving operation is performed in a thermostatic bath at 33-37 degrees Celsius for 24 hours.

Then upper 90% by volume of the solution after the microwaving operation is extracted to obtain the anti-mosquito dye stock.

Next, as described in step S440, the anti-mosquito dye stock is mixed with a second amount of pure water to formulate an appropriate ratio to produce a liquid for soaking the housing. In an embodiment, step S440 is completely dissolving 4 wt % to 8 wt % of the anti-mosquito dye stock in the pure water, and controlling the temperature to be in a range of 20-30 degrees Celsius. In an embodiment, the pure water added in the foregoing steps S420 and S440 is high purity water.

Through the surface treatment method provided in the disclosure, the anti-mosquito ingredient is injected into the housing through the anodizing treatment, thereby providing an anti-mosquito function for the housing. In this way, a problem that the user is easily disturbed and bitten by mosquitoes when operating an electronic device such as a laptop computer, a tablet computer, and a smartphone is avoided, thereby improving operating experience of the user.

The above is merely preferred embodiments of the disclosure, and does not impose any limitation on the disclosure. Any form of change such as an equivalent replacement or modification made by any person skilled in the art to technical means and technical content provided in the disclosure without departing from scope of the technical means of the disclosure is content that does not deviate from the technical means of the disclosure, and still falls within the protection scope of the disclosure.

What is claimed is:

1. A surface treatment method, comprising:

providing a housing;

preparing a liquid, wherein the liquid comprises at least one anti-mosquito ingredient;

performing an anodizing treatment on the housing, to form micropores on a surface of the housing;

immersing the housing in the liquid; and sealing the micropores on the surface of the housing.

2. The surface treatment method according to claim 1, wherein the liquid further comprises a dyeing ingredient.

3. The surface treatment method according to claim 1, wherein the housing is composed of aluminum, an aluminum alloy, titanium, or a titanium alloy.

4. The surface treatment method according to claim 2, wherein the dyeing ingredient is selected from a group consisting of bluegrass, safflower, turmeric, and gardenia.

5. The surface treatment method according to claim 1, wherein a step of preparing the liquid comprises:

formulating an anti-mosquito powder;

adding the anti-mosquito powder to a first amount of pure water, and performing trituration and filtration, to produce an anti-mosquito solution;

adding a dye to the anti-mosquito solution to produce an anti-mosquito dye stock; and mixing the anti-mosquito dye stock with a second amount of pure water to produce the liquid.

6. The surface treatment method according to claim 5, wherein a step of adding the dye to the anti-mosquito solution to produce the anti-mosquito dye stock comprises:

adding the dye to the anti-mosquito solution to produce an anti-mosquito dye mixture; and microwaving the anti-mosquito dye mixture to produce the anti-mosquito dye stock.

7. The surface treatment method according to claim 5, wherein the anti-mosquito powder comprises ethyl butylacetylaminopropionate, p-Menthane-3,8-diol, citronellol, and eucalyptus.

8. The surface treatment method according to claim 5, wherein the liquid comprises 4 wt %-8 wt % of the anti-mosquito dye stock.

9. The surface treatment method according to claim 1, wherein a size of the micropores is in a range of 20-40 nanometers.

10. The surface treatment method according to claim 1, wherein a step of immersing the housing in the liquid comprises:

preparing a soaking tank, and putting the liquid into the soaking tank; and putting the housing in the soaking tank for a soaking time, wherein the soaking time is in a range of 15-40 minutes.

* * * * *